US011318488B2

(12) United States Patent
Sun et al.

(10) Patent No.: US 11,318,488 B2
(45) Date of Patent: May 3, 2022

(54) SPRAY POT AND PAINT SPRAYING SYSTEM

(71) Applicant: SHENZHEN WISDOM SCIENCE AND TECHNOLOGY CO., LTD, Guangdong (CN)

(72) Inventors: Hui Sun, Guangdong (CN); Ian Hussey, Guangdong (CN)

(73) Assignee: SHENZHEN WISDOM SCIENCE AND TECHNOLOGY CO., LTD

( * ) Notice: Subject to any disclaimer, the term of this patent is extended or adjusted under 35 U.S.C. 154(b) by 260 days.

(21) Appl. No.: 16/697,702

(22) Filed: Nov. 27, 2019

(65) Prior Publication Data

US 2020/0094276 A1 Mar. 26, 2020

Related U.S. Application Data

(63) Continuation-in-part of application No. PCT/CN2017/101783, filed on Sep. 14, 2017.

(51) Int. Cl.

| | |
|---|---|
| ***B05B 7/24*** | (2006.01) |
| ***B05B 15/40*** | (2018.01) |
| ***B05B 7/00*** | (2006.01) |
| ***B05B 7/12*** | (2006.01) |

(52) U.S. Cl.

CPC ..... *B05B 7/2408* (2013.01); *B05B 7/0081* (2013.01); *B05B 7/12* (2013.01); *B05B 15/40* (2018.02)

(58) Field of Classification Search

CPC ..... B05B 7/2408; B05B 15/40; B05B 7/0081; B05B 7/12

USPC ..... 239/354, 346, 302, 379

See application file for complete search history.

(56) References Cited

U.S. PATENT DOCUMENTS

| | | | | |
|---|---|---|---|---|
| 3,934,746 | A | 1/1976 | Lilja | |
| 6,435,426 | B1 | 8/2002 | Corp | |
| 6,953,155 | B2 * | 10/2005 | Joseph | B05B 7/241 239/346 |
| 7,036,752 | B1 * | 5/2006 | Hsiang | B05B 7/2408 239/379 |

(Continued)

FOREIGN PATENT DOCUMENTS

| | | |
|---|---|---|
| CN | 2114634 U | 9/1992 |
| CN | 1244141 A | 2/2000 |

(Continued)

OTHER PUBLICATIONS

International Search Report and Written Opinion from International Application No. PCT/CN2017/101783, dated Feb. 26, 2018.

*Primary Examiner* — Steven J Ganey

(74) *Attorney, Agent, or Firm* — McDonald Hopkins LLC

(57) ABSTRACT

Provided is a spray pot which includes: a body; a detachable inner liner arranged in the body; a closing member which is arranged at the bottom of the inner liner, is in a closed state when the body is placed uprightly and fluid is injected into the inner liner, and is in an opened state when the body is inverted and the fluid is discharged from the inner liner; clamping portions arranged at a bottom of the body and configured to fix the closing member to the body; and a cover arranged at a top of the body, connected with a spray gun, and tightly matched with both the body and the inner liner.

16 Claims, 16 Drawing Sheets

(56) References Cited

U.S. PATENT DOCUMENTS

| | | | | |
|---|---|---|---|---|
| 7,766,250 | B2 * | 8/2010 | Kosmyna | B05B 7/2478 239/345 |
| 2004/0164182 | A1 | 8/2004 | Joseph et al. | |
| 2004/0217201 | A1 | 11/2004 | Ruda | |
| 2006/0196891 | A1 | 9/2006 | Gerson et al. | |
| 2013/0168468 | A1 | 7/2013 | Biagio et al. | |

FOREIGN PATENT DOCUMENTS

| | | | |
|---|---|---|---|
| CN | 1723088 | A | 1/2006 |
| CN | 201020437 | Y | 2/2008 |
| CN | 202506553 | U | 10/2012 |
| CN | 204710607 | U | 10/2015 |
| CN | 106423612 | A | 2/2017 |
| EP | 0064695 | | 11/1982 |
| JP | 2001508698 | | 7/2001 |
| JP | 2008202624 | | 9/2008 |
| JP | 2010017716 | | 1/2010 |
| JP | 2015148173 | | 8/2015 |
| JP | 2016508870 | | 3/2016 |
| WO | 2003045575 | | 6/2003 |
| WO | 2005077543 | | 8/2005 |
| WO | 2006065850 | | 6/2006 |

* cited by examiner

SPRAY POT AND PAINT SPRAYING SYSTEM

CROSS REFERENCE TO RELATED APPLICATION

This application is a Continuing-in-part Application of co-pending international patent application number PCT/CN2017/101783, filed on Sep. 14, 2017 which claims priority to Chinese patent application No. 201720607912.4 filed on May 27, 2017, disclosures of both of which are incorporated herein by reference in their entireties.

TECHNICAL FIELD

The present disclosure relates to the technical field of spray pots, and particularly relates to a spray pot with an inner liner and a paint spraying system.

BACKGROUND

At present, spray pots on the market have a single function. The spray pots need to be washed after use or when a paint needs to be changed, thereby greatly reducing working efficiency and also wasting a lot of paint cleaning solvents. No-clean paint spray pots in a related art adopt a principle of compression, so that paint may be used incompletely to cause waste of the paint.

SUMMARY

A purpose of the present disclosure is to provide a spray pot. Paint can be completely sprayed from the spray pot to achieve a purpose of saving paint. In addition, a body can be repeatedly used to increase working efficiency, and it is ensured that the fluid does not leak when fluid such as paint, coating and the like is injected into the inner liner and the inner liner is not compressed when the fluid is discharged from the inner liner, so that the spray pot not only is simple in structure, but also is convenient to operate.

The spray pot includes:

a body;

a detachable inner liner arranged in the body;

a one-way ventilation valve which is arranged at the bottom of the inner liner, is in a closed state when the body is placed uprightly and fluid is injected into the inner liner, and is in an opened state when the body is inverted and the fluid is discharged from the inner liner;

clamping portions which are arranged at the bottom of the body and configured to fix the one-way ventilation valve to the body; and a cover which is arranged at a top of the body, connected with a spray gun and tightly matched with the body and the inner liner.

The detachable inner liner is arranged in the body, so that the body can be used without direct contact with paint and achieves the purposes of reusability and no-clean, thereby realizing a technical effect of increasing working efficiency. The one-way ventilation valve is arranged at the bottom of the inner liner, and the clamping portions for fixing the one-way ventilation valve are arranged at the bottom of the body, so as to achieve technical effects that the fluid does not leak when the fluid is injected into the inner liner and the inner liner is not deformed and compressed when the fluid is discharged from the inner liner.

Optionally, the one-way ventilation valve allows external air to flow into the inner liner through the one-way ventilation valve when an air pressure in the inner liner is lower than an external pressure. The paint in the spray pot can be completely sprayed out during use by the one-way ventilation valve.

Optionally, a plurality of flanges are arranged on a circumferential side of the one-way ventilation valve; a through-hole is formed in the bottom of the body; a plurality of notches are formed in a circumferential side of the through-hole of the body, the flanges pass through the plurality of notches; and the body between the adjacent notches forms the clamping portions. During use, the inner liner is rotated firstly so that the flanges of the one-way ventilation valve correspond to positions of the notches, and the one-way ventilation valve penetrates through the body via the through-hole; and the inner liner is rotated again so that the flanges of the one-way ventilation valve are matched with the clamping portions to fix the one-way ventilation valve and the inner liner to the body and prevent the inner liner from moving up and down and/or rotating during operation.

Optionally, the one-way ventilation valve is bonded to the inner liner by hot-pressing or ultrasonic waves.

Optionally, a detachable first filter mesh is arranged on the cover; and the cover is provided with a lug boss for mounting the first filter mesh and a clamping buckle for fixing the first filter mesh. The detachable first filter mesh is configured to filter impurities in the fluid entering the inner liner, therefore the frequency of cleaning the body is effectively reduced, and the work of filtering the fluid such as the paint, and the like before use is also reduced, thereby reducing labor cost and increasing the working efficiency. Moreover, when the same kind fluid is used continuously, a user just need to replace the first filter mesh simply without replacing the inner liner, thereby reducing the frequency of replacing the inner liner and further reducing the waste of the fluid.

Optionally, an annular clamping groove is provided along a circumference of an upper portion of the body; and an elastic clamping hook matched with the annular clamping groove is arranged on the circumferential side of the cover.

Optionally, the cover is provided with a first connector for connecting with a spray gun or a plug for sealing the body. When the cover is used together with the spray gun, the cover is connected with the spray gun by the first connector. When the body is stilled filled with the fluid, but is not used temporarily and in short term, the body can be sealed by the plug so as to effectively protect the fluid in the body and prevent the fluid from being polluted by impurities in the air and volatilizing. In addition, after the body is filled with the paint, the body can be sealed by the plug firstly, then the body is inverted, the plug is removed after the paint in the body is shaken up, the cover is connected with the spray gun by the first connector, and then the body is inverted for use, thereby reducing a process that the fluid such as the paint and the like must be mixed separately before use every time, increasing the working efficiency and saving a container for mixing the paint.

Optionally, a filter head assembly is arranged between the cover and the spray gun; a first end of the filter head assembly is fixedly connected with the cover by threads; and a second end of the filter head assembly is fixedly connected with the spray gun by a second connector.

Optionally, the filter head assembly includes a first cover body connected with the cover and a second cover body connected with the second connector; and a detachable second filter mesh is arranged between the first cover body and the second cover body.

Optionally, the first cover body is fixedly connected with the second cover body by threads.

Optionally, the second filter mesh is fixed by compression of the first cover body and the second cover body.

The detachable inner liner is arranged in the body, so that the body can be repeatedly used and does not need to be cleaned frequently, thereby increasing the working efficiency. The one-way ventilation valve is arranged at the bottom of the inner liner, and the clamping portions for fixing the one-way ventilation valve are arranged at the bottom of the body, so that the fluid does not leak when the fluid is injected into the inner liner and the inner liner is not deformed and compressed when the fluid is discharged from the inner liner. In addition, the spray pot of the present disclosure is in the inverted state when being used, and is in the upright state when being filled with the paint, so as to avoid a problem that when the spray pot is in the inverted state during being filled with the paint an additional rack is required to support the body.

BRIEF DESCRIPTION OF DRAWINGS

Exemplary embodiments of the present disclosure will be described below in detail with reference to drawings so that those ordinary skilled in the art may understand the above and other features of the present disclosure more clearly.

LIST OF REFERENCE NUMERALS

Figure 1:
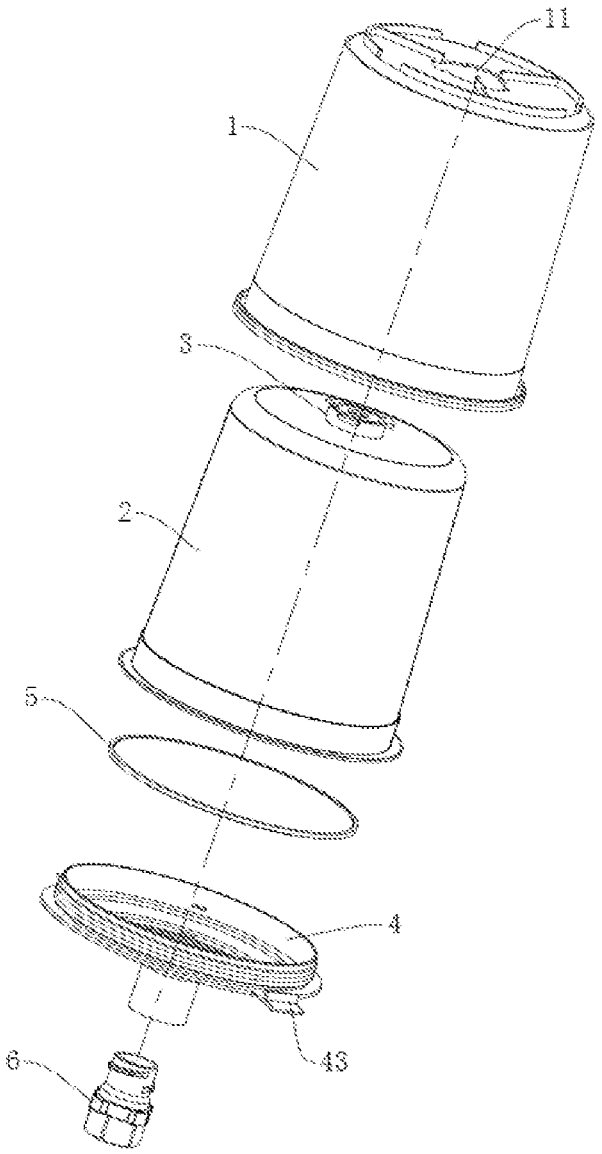
FIG. 1 is an exploded schematic diagram illustrating a spray pot of an embodiment 1 of the present disclosure.
Figure 2:
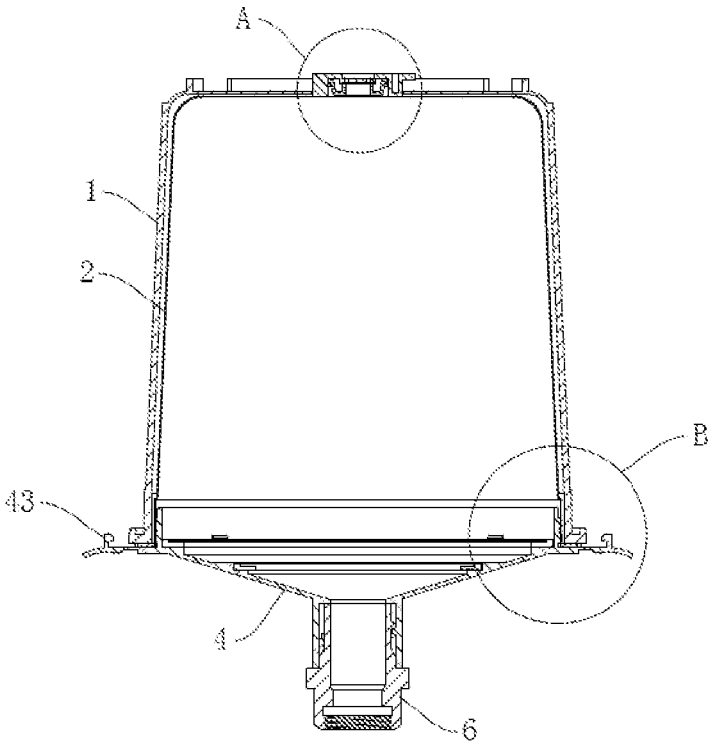
FIG. 2 is a sectional view illustrating the spray pot of the embodiment 1 of the present disclosure.
Figure 3:
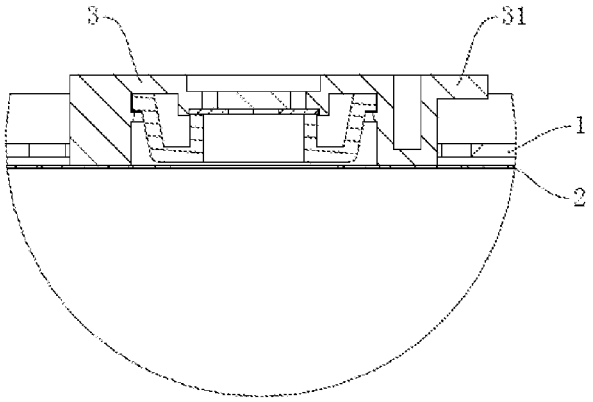
FIG. 3 is an enlarged view illustrating a position A in FIG. 2.
Figure 4:
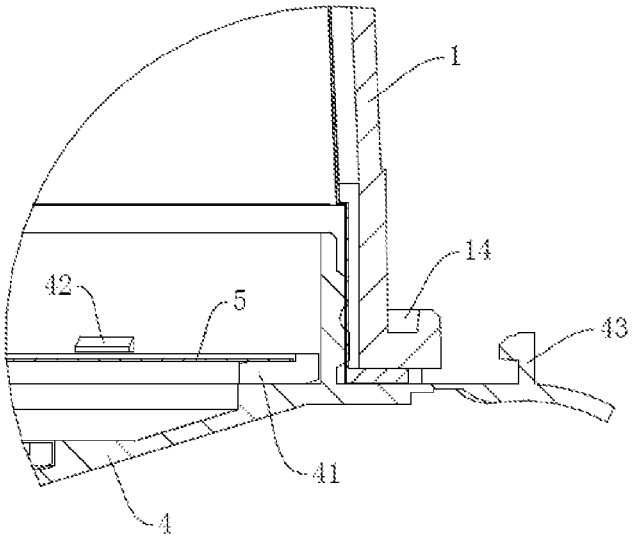
FIG. 4 is an enlarged view illustrating a position B in FIG. 2.
Figure 5:
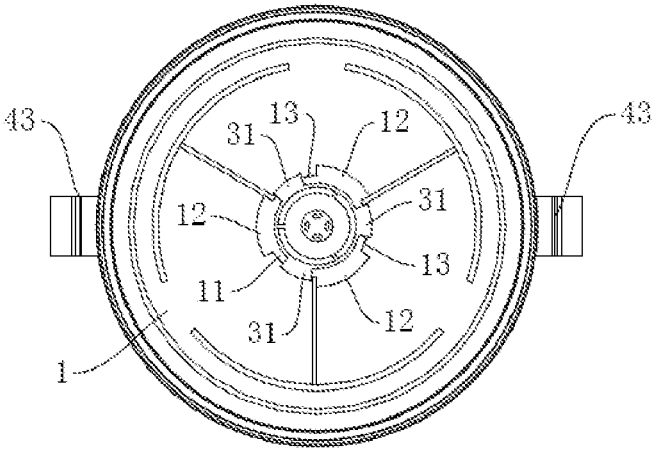
FIG. 5 is a top view illustrating the spray pot in FIG. 2.

1 body; 11 through-hole; 12 opening; 13 clamping position; 14 annular clamping groove; 2 inner liner; 3 one-way ventilation valve; 31 flange; 32 lower cover; 33 base; 34 upper cover; 35 gasket; 36 groove; 37 spring; 4 cover; 41 lug boss; 42 clamping buckle; 43 elastic clamping hook; 5 first filter mesh; 6 first connector; 7 plug; 8 filter head assembly; 81 first cover body; 82 second cover body; 83 second filter mesh; and 9 second connector; 21 ventilation hole; 38 closing valve; 381 valve body; 382 valve plate; 383 valve hole; 15 annular lug stripe.

DETAILED DESCRIPTION

Technical solutions of the present disclosure are further described below in combination with FIG. 1 to FIG. 9 through specific embodiment. In the case of no conflict, the following embodiments and features in embodiments can be combined with each other.

Embodiment 1

As shown in FIG. 1 to FIG. 5, a spray pot includes a body 1. A detachable inner liner 2 is arranged in the body 1. A one-way ventilation valve 3 is arranged at the bottom of the inner liner 2. Clamping portions 13 for fixing the one-way ventilation valve 3 are arranged at the bottom of the body 1. A cover 4 for connecting with a spray gun is arranged at the top of the body 1. The cover 4 is tightly matched with the body 1 and the inner liner 2. When the body 1 is placed uprightly and fluid is injected into the inner liner 2, the one-way ventilation valve 3 is in a closed state. When the body 1 is inverted and the fluid is discharged from the inner liner 2, the one-way ventilation valve 3 is in an opened state. Optionally, the body is placed uprightly when the top is above the bottom; and the body is inverted when the bottom is above the top.

By adopting a technical means that the detachable inner liner 2 is arranged in the body 1, the body 1 can be used without direct contact with the paint to achieve the purposes of reusability and no cleaning, and realize a technical effect of indirectly increasing working efficiency. A technical means that the one-way ventilation valve 3 is arranged at the bottom of the inner liner 2 is adopted to realize technical effects that the fluid does not leak when the fluid is injected into the inner liner 2 and the inner liner 2 is not deformed and compressed when the fluid is discharged from the inner liner 2. In addition, the spray pot provided by the present disclosure is in an inverted state when being used, and is in an upright state when being filled with the paint, so as to solve technical problems that the spray pot in the existing art is also in the inverted state when being filled with the paint and an additional rack is required to support the body 1 when the spray pot in the inverted state is filled with the paint.

In the present embodiment, the one-way ventilation valve 3 is configured as a valve body in which the outside air flows in one direction. When an air pressure in the inner liner 2 is lower than an external air pressure, the external air flows into the inner liner through the one-way ventilation valve 3. Optionally, the one-way ventilation valve 3 is bonded to the inner liner 2 by hot-pressing or ultrasonic waves. In the present embodiment, the one-way ventilation valve 3 is bonded to the inner liner 2 by hot-pressing. In other embodiments, the one-way ventilation valve 3 can also be bonded to the inner liner 2 in other manners such as ultrasonic waves and the like. The paint in the spray pot can be completely sprayed out during use by the one-way ventilation valve 3.

Figure 10:
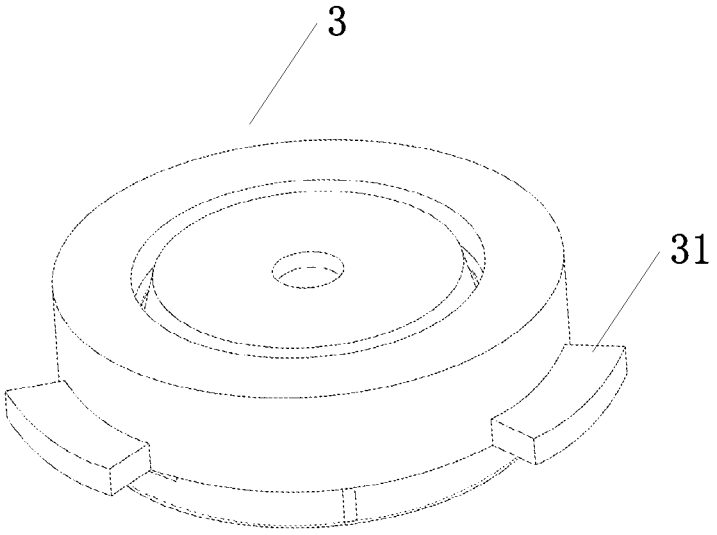
FIG. 10 is an assembly view illustrating a one-way ventilation valve of an embodiment of the present disclosure.
Figure 11:
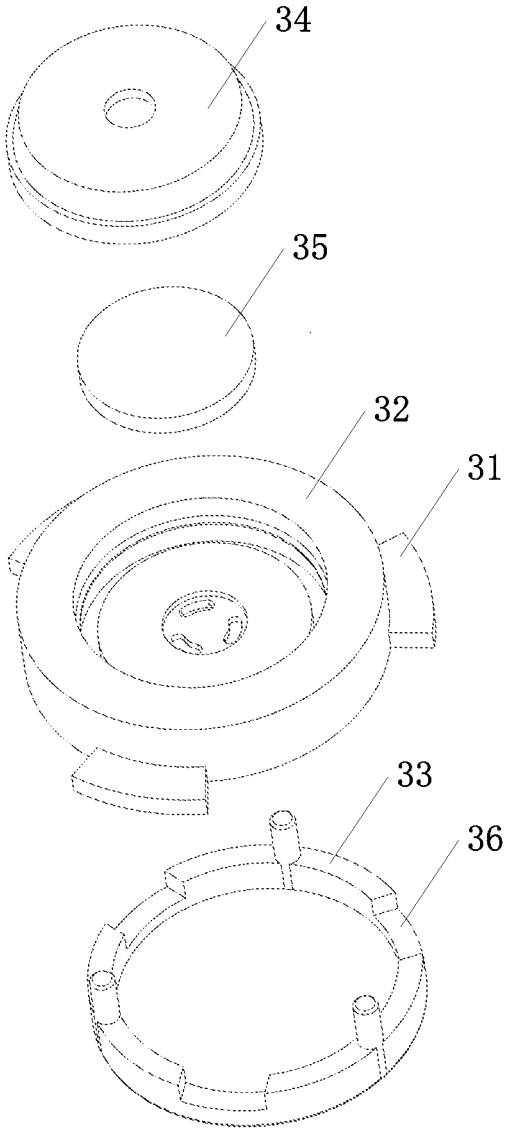
FIG. 11 is an exploded view illustrating a one-way ventilation valve of an embodiment of the present disclosure.

As shown in FIG. 10 and FIG. 11, the one-way ventilation valve 3 includes a base 33, an upper cover 34, a lower cover 32 and a gasket 35. A surface of the upper cover 34 in contact with the gasket 35 is provided with ridges. The lower cover 32 is provided with a plurality of flanges 31. Optionally, the gasket 35 is a silicone gasket. The base 33 is provided with grooves 36 matched with the flanges 31. A length of each flange 31 is greater than a width of each first groove 36 so that portions of the flanges 31 extend out of the grooves 36 after the lower cover 32 is fixed to the base 33. As shown in FIG. 11, the base 33 has a hollow structure. The base 33 is annular; and the lower cover 32 is circular. The plurality of flanges 31 are arranged on a side wall of the circular lower cover 32. In one embodiment, a diameter of the circular lower cover 32 is substantially equal to an inner diameter of the annular base 33. A groove is formed in the lower cover 32. A lug boss is arranged in the second groove. A through-hole through which the paint flows is formed in the lug boss. The upper cover 34 and the gasket 35 are arranged in the groove. The gasket 35 is arranged between the upper cover 34 and the lug boss of the lower cover 32. An opening through which the paint flows is formed in the upper cover 34. In one embodiment, the upper cover 34 can be tightly matched with the lower cover 32.

Figure 12:
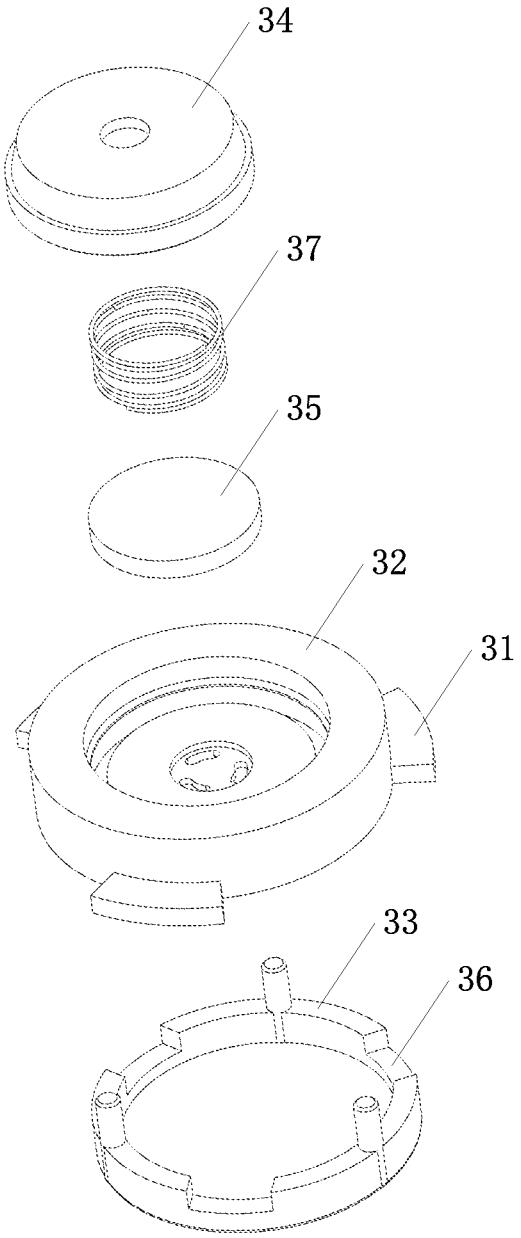
FIG. 12 is an exploded view illustrating a one-way ventilation valve of another embodiment of the present disclosure.

As shown in FIG. 12, in another embodiment, the one-way ventilation valve 3 also includes a spring 37. The spring 37 is arranged between the upper cover 34 and the gasket 35.

When the spray pot is placed uprightly and after liquid enters the body 1, the gasket 35 is completely fitted with the lower cover 32 so that the liquid cannot flow out of the body 1. When the spray pot is inverted, the surface of the upper cover 34 in contact with the gasket 35 is provided with the ridges, so when the air pressures inside and outside the body 1 are not consistent, the gasket 35 cannot be completely fitted with the upper cover due to the presence of the ridges, the air can enter the body, and the inner liner 2 is not extruded and deformed due to imbalance of the air pressures, so as to realize one-way ventilation.

In the present embodiment, a plurality of flanges 31 are arranged on a circumferential side of the one-way ventilation valve 3. A through-hole 11 is formed at the bottom of the body 1. A plurality of notches 12 are formed in a circumferential side of the through-hole 11 of the body 1, and the plurality of flanges 31 pass through the plurality of notches 12. Bottom walls of the body 1 between the adjacent notches 12 form the clamping portions 13. When the inner liner 2 is placed in the body 1, the inner liner 2 is rotated firstly so that the flanges 31 of the one-way ventilation valve 3 correspond to positions of the notches 12, and the one-way ventilation valve 3 passes through the body 1 through the through-hole 11; and the inner liner 2 is rotated again so that the flanges 13 of the one-way ventilation valve 3 are matched with the clamping portions 13 to fix the one-way ventilation valve 3 and the inner liner 2 to the body 1 and prevent the inner liner 2 from moving up and down and/or rotating during operation.

Optionally, the number of the flanges 31 is three, and the number of the notches 12 is also three. By rotating a structure of the clamping portion 13, the inner liner 2 is replaced more conveniently and it is ensured that the inner liner 2 is not compressed and deformed due to influence of the air pressure during use. Optionally, limiting protrusions (not shown) for limiting the flanges 31 are also arranged at the bottom of the body 1.

In the present embodiment, a detachable first filter mesh 5 is arranged on the cover 4. The cover 4 is provided with a lug boss 41 for mounting the first filter mesh 5 and clamping buckles 42 for fixing the first filter mesh 5. By arranging the detachable first filter mesh 5 on the cover 4, impurities in the fluid entering the inner liner 2 are filtered, the frequency of cleaning the body 1 is effectively reduced, and also work of filtering the fluid such as the paint and the like before use relative to the existing art is reduced, thereby reducing labor cost and increasing the working efficiency. Moreover, when the same kind fluid is used continuously, a user can just simply replaces the first filter mesh 5 without replacing the inner liner 2, thereby reducing the frequency of replacing the inner liner 2 and further reducing the waste of the fluid. However, when the same fluid is used for a relatively long term or the fluid needs to be replaced with another fluid timely, the inner liner 2, the first filter mesh 5 and the cover 4 need to be replaced at the same time. Optionally, a mesh size of the first filter mesh 5 can be selected as needed. Optionally, the first filter mesh 5 is formed by bonding a rubber ring to a mesh by hot-pressing.

In the present embodiment, an annular clamping groove 14 is provided along a circumference of an upper portion of the body 1; and an elastic clamping hook 43 matched with the annular clamping groove 14 is arranged on the circumferential side of the cover 4. A first connector 6 for connecting with the spray gun is arranged on the cover 4. When the cover is used together with the spray gun, the cover 4 is connected with the spray gun by the first connector 6. The type of the first connector 6 can be selected according to the type of the spray gun to be matched.

In the present embodiment, scales are arranged on the body 1, so that the amount of the fluid can be measured as needed when the body is used.

Embodiment 2

Figure 6:
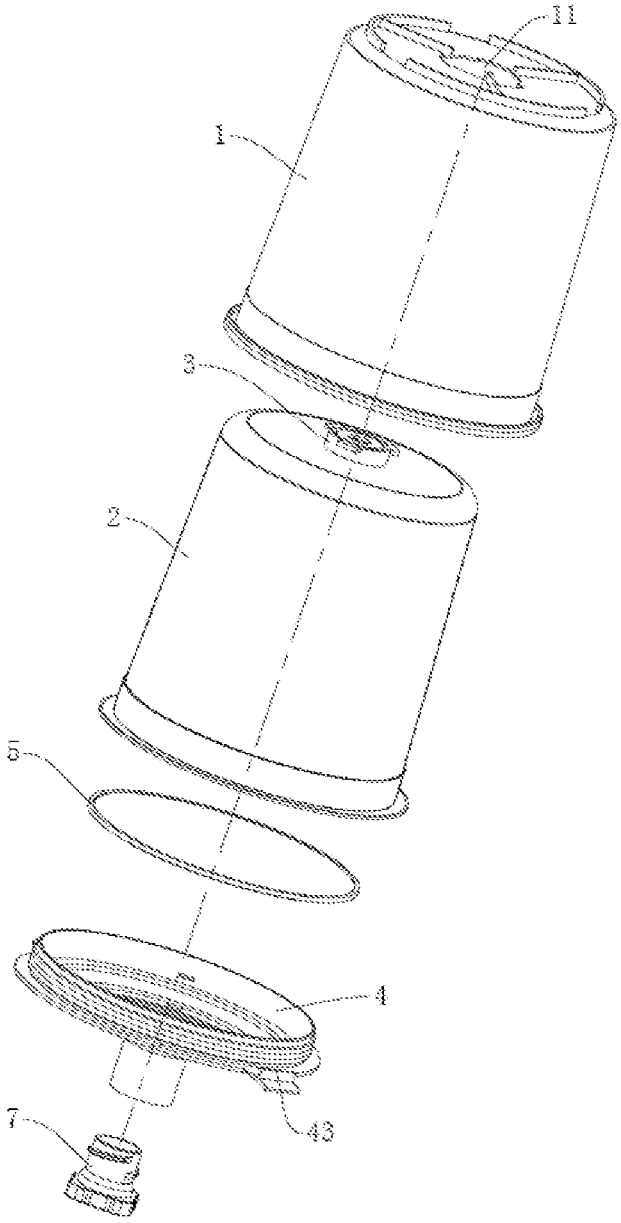
FIG. 6 is an exploded schematic diagram illustrating a spray pot of an embodiment 2 of the present disclosure.
Figure 7:
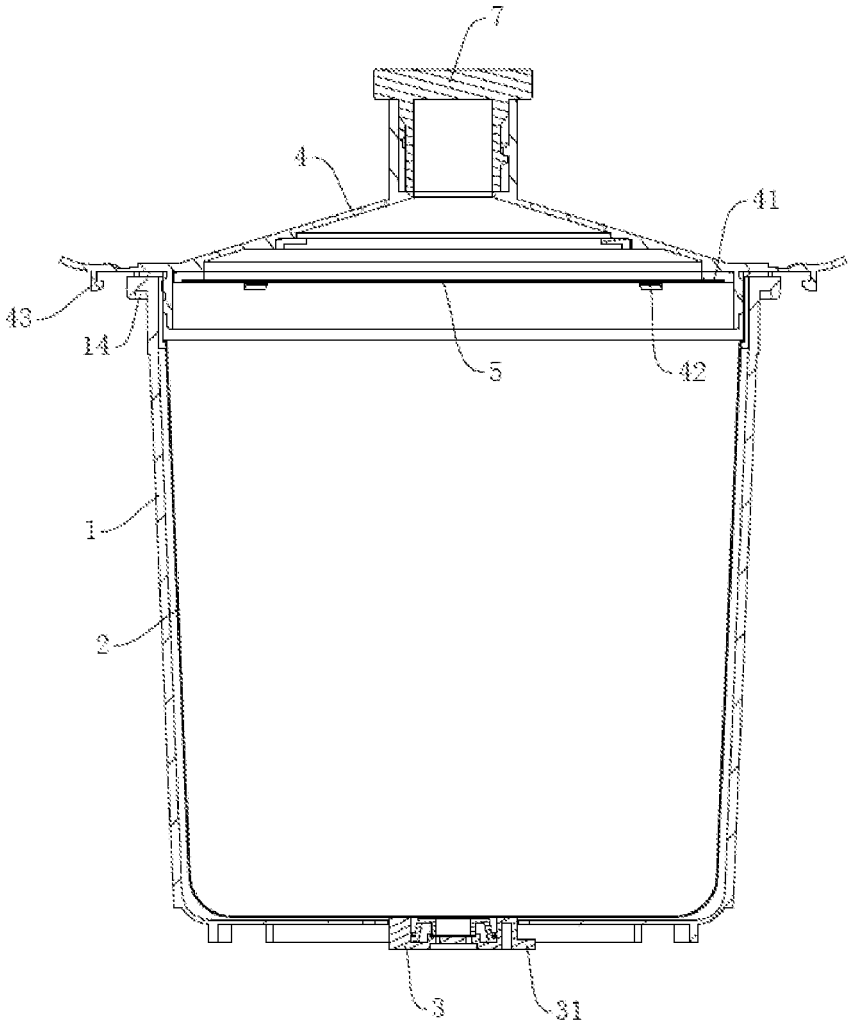
FIG. 7 is a sectional view illustrating the spray pot of the embodiment 2 of the present disclosure.

The present embodiment is based on the embodiment 1. The present embodiment and the embodiment 1 are different in that:

As shown in FIG. 6 and FIG. 7, in the present embodiment, the cover 4 is provided with a plug 7 for sealing the body 1. When the body 1 is still filled with the fluid, but is not used temporarily in short term, the body 1 can be sealed by the plug 7 so as to effectively protect the fluid in the body 1 and prevent the fluid from being polluted by impurities in the air and volatilizing. In addition, after the body 1 is filled with the paint, the body 1 can be sealed by the plug 7 firstly, then the body 1 is inverted, the plug 7 is removed after the paint in the body 1 is shaken up, the cover 4 is connected with the spray gun by the first connector 6, and then the body 1 is inverted for use, thereby reducing a process that the fluid such as the paint and the like must be mixed separately before use every time, increasing the working efficiency and saving a container for mixing the paint.

Embodiment 3

Figure 8:
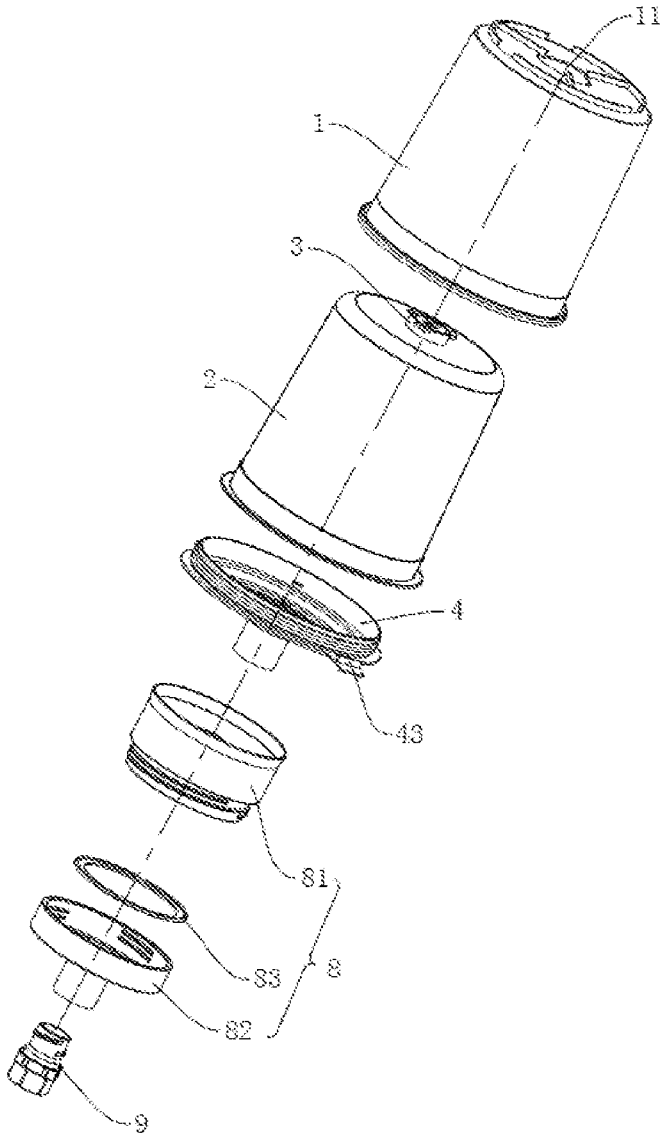
FIG. 8 is an exploded schematic diagram illustrating a spray pot of an embodiment 3 of the present disclosure.
Figure 9:
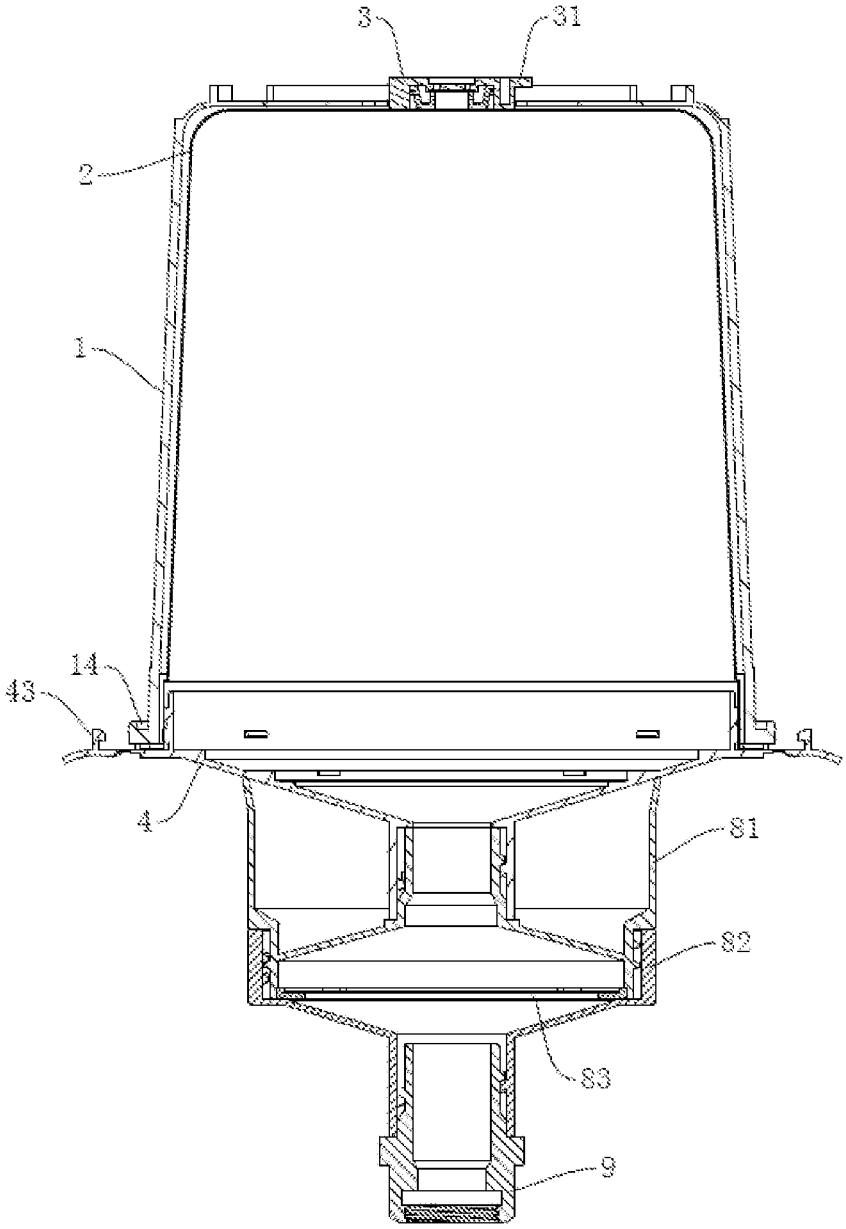
FIG. 9 is a sectional view illustrating a spray pot of an embodiment 3 of the present disclosure.

The present embodiment is based on the embodiment 1. The present embodiment and the embodiment 1 are different in that:

As shown in FIG. 8 and FIG. 9, in the present embodiment, the cover 4 is only used as a sealing element matched with the body 1. The first filter mesh 5 is not arranged on the cover 4. A filter head assembly 8 is arranged between the cover 4 and the spray gun. A first end of the spray head assembly 8 is fixedly connected with the cover 4 by threads. A second end of the filter head assembly 8 is fixedly connected with the spray gun by a second connector 9. Optionally, the structure of the second connector 9 is identical to that of the first connector 6 in the embodiment 1 so as to reduce production cost and improve versatility of the first connector 6 and the second connector 9.

In the present embodiment, the filter head assembly 8 includes a first cover body 81 connected with the cover 4 and a second cover body 82 connected with the second connector 9. A detachable second filter mesh 83 is arranged between the first cover body 81 and the second cover body 82. The second filter mesh 83 is tightly fitted with the first cover body 81 and the second cover body 82. The first cover body 81 is fixedly connected with the second cover body 82 by threads. Optionally, the second filter mesh 83 is fixed by compression of the first cover body 81 and the second cover body 82. The second filter mesh 83 is replaceable. A mesh size of the second filter mesh 83 can be selected as needed. Optionally, the second filter mesh 83 is formed by bonding a rubber ring to a mesh by hot-pressing.

A technical means that the filter head assembly 8 is arranged between the cover 4 and the spray gun is adopted to achieve the purpose of filtering impurities in the fluid, effectively reduce the frequency of cleaning the body 1, and increase the working efficiency. Moreover, when the same fluid is used, a user just need replace the filter head assembly 8 without replacing the inner liner 2 immediately, thereby reducing the frequency of replacing the inner liner 2 and further reducing the waste of the fluid. However, when the same fluid is used for a relatively long time or the fluid needs to be replaced with another fluid timely, the inner liner 2, the cover 4 and the filter head assembly 8 need to be replaced timely.

In addition, the filter head assembly 8 provided by the present disclosure can also be used together with an ordinary cup and a spray gun to achieve the purpose of filtering the impurities in the fluid.

Embodiment 4

Figure 13:
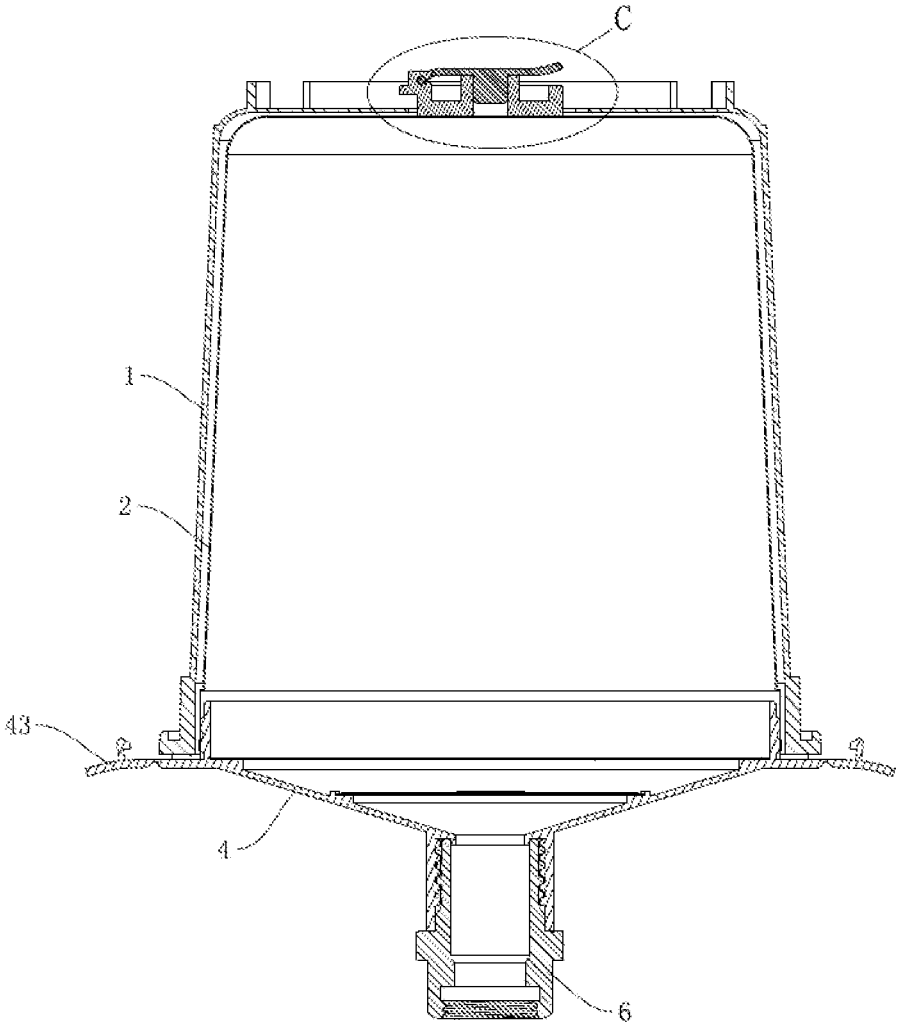
FIG. 13 is a sectional view illustrating a spray pot of an embodiment 4 of the present embodiment.
Figure 14:
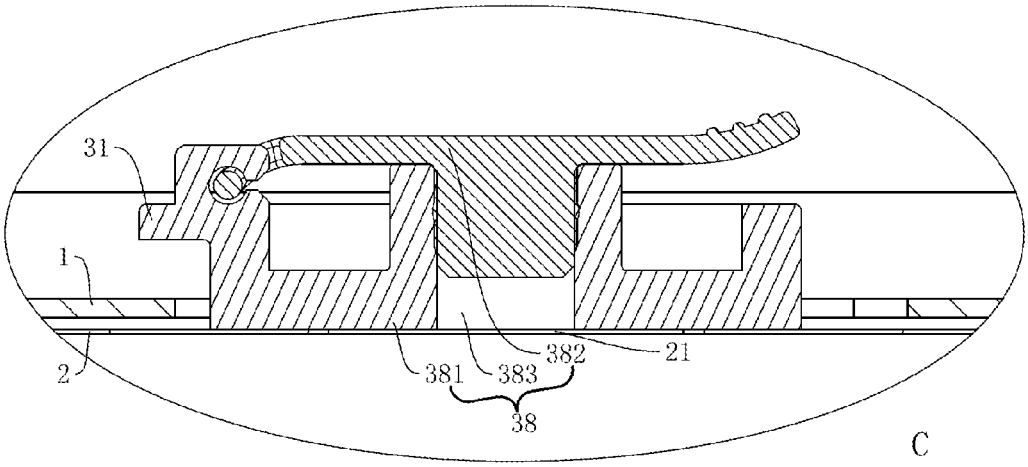
FIG. 14 is an enlarged view illustrating a position C in FIG. 13.

Based on the above embodiments, as shown in FIG. 13 to FIG. 18, a spray pot is provided by the present embodiment. As shown in FIG. 13 and FIG. 14, a ventilation hole 21 is arranged on the inner liner 2. The spray pot provided by the present embodiment and the spray pots provided by the above embodiments are different in that: no one-way ventilation valve is arranged at the ventilation hole 21, while a closing valve 38 is fixed on an outside of the inner liner 2, and the closing valve 38 is configured to close the ventilation hole 21. When the spray pot is used, the closing valve 38 closes the ventilation hole 21 and the fluid may be injected into the inner liner 2 (at this moment, the body is generally placed uprightly). When the fluid needs to be ejected outwards, the closing valve 38 may be opened and the fluid may flow to the opening of the body 1 from the inner liner 2, that is, flow out of the cover 4.

When the closing valve 38 provided by the present embodiment is used, the closing valve 38 is firstly closed before the fluid is injected into the spray pot. When the fluid (for example, the paint is ejected outwards) is ejected out of the spray pot from the inner liner 2, the closing valve 38 is opened after the body is inverted or tilted, which is convenient for the air to enter from the ventilation hole 21 when the fluid flows out of the cover. When the fluid is stored by the spray pot, the closing valve 38 can completely prevent the fluid from leaking from the ventilation hole 21. The closing valve 38 may be made of a rubber or the like, for example, the closing valve 38 may be a rubber plug. Of course, the closing valve may be made of other materials as long as the ventilation hole is tightly sealed.

The ventilation hole 21 may be located on the bottom of the inner liner 2, or located on other area of the inner liner 2 such as a side portion.

In one embodiment, the closing valve 38 includes a valve body 381 and a valve plate 382. The valve body 381 is connected to the inner liner 2. And the valve body 381 may be connected to the inner liner 2 by ultrasonic welding, or hot pressing, or the like, which is not limited by the present embodiment. The valve body 381 is provided with a valve hole 383. The valve hole 383 is communicated with the ventilation hole 21. One end of the valve plate 382 is hingedly connected to the valve body 381, and the valve plate 382 is capable of closing the valve hole 383. A protrusion portion is arranged protruding from an inner end surface of the valve plate 382. When the valve plate 382 is rotated towards the valve hole 383, the protrusion portion of the valve plate 382 may be inserted into the valve hole 383 and block the valve hole 383. Another end of the valve plate 382 may be tilted upwardly, which is convenient for the user of the spray pot to open or close the valve hole 383 from the another end of the valve plate 382.

In summary, whether the closing valve or the one-way ventilation valve is adopted or both the closing valve and the one-way ventilation valve are provided, a closing member capable of closing the ventilation hole 21 is arrange on the inner liner 2. After the ventilation hole 21 is closed by the closing member, the fluid can be prevented from leaking when the fluid is injected into the inner liner 2 from the opening of the body 1. When fluid needs to flow out (flowing out from a side of the cover), the closing member is in an opening state, to make sure that the air may pass through the ventilation hole 21 and prevent the inner liner 2 from being deformed. The closing member is connected to the inner liner 2. And the closing member is connected to the inner liner 2 by ultrasonic welding, or hot pressing, or the like, which is not limited by the present embodiment.

Figure 15:
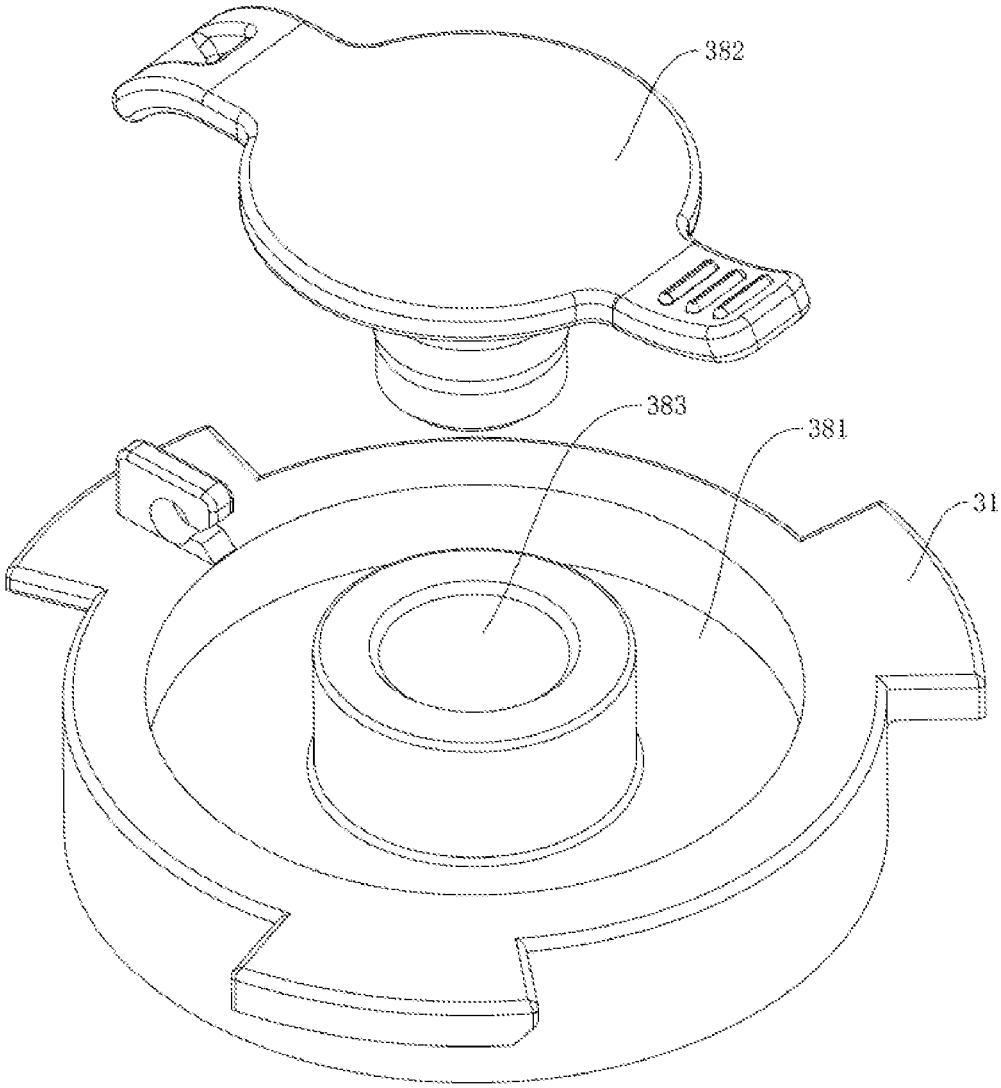
FIG. 15 is an exploded schematic diagram illustrating a closing valve of an embodiment of the present disclosure.
Figure 16:
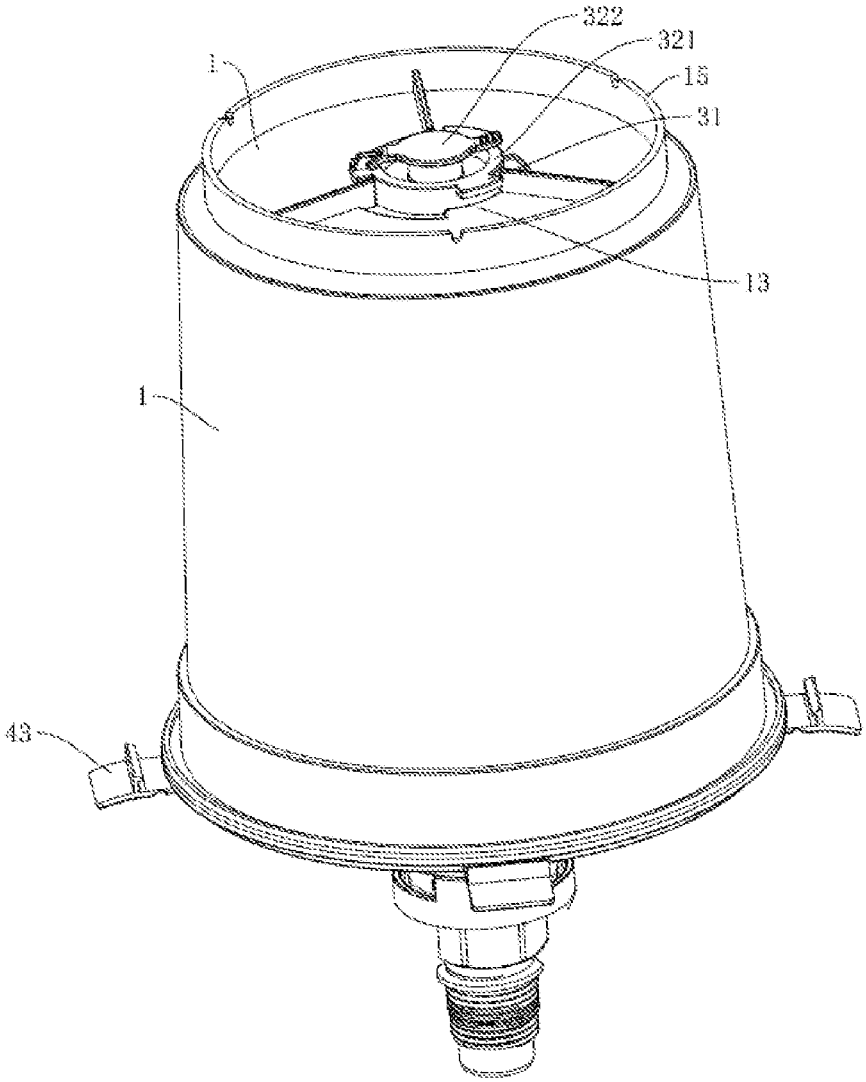
FIG. 16 is an assembly effect view illustrating a closing valve of an embodiment of the present disclosure.

In the present embodiment and the above embodiments, the ventilation hole 21 is located on the bottom of the inner liner 2. Similar to the above embodiments, a plurality of flanges 31 are arranged protruding from the closing member. As shown in FIG. 15 and FIG. 16, for the closing valve, the plurality of flanges 31 are arranged along an outer circumference of the valve body 381, and the clamping portions 13 are arranged on the bottom of the body, and cooperated to fix with the flanges, so as to prevent the inner liner from moving. The clamping portions 13 may be relative-conveniently arranged on the bottom of the body.

Figure 17:
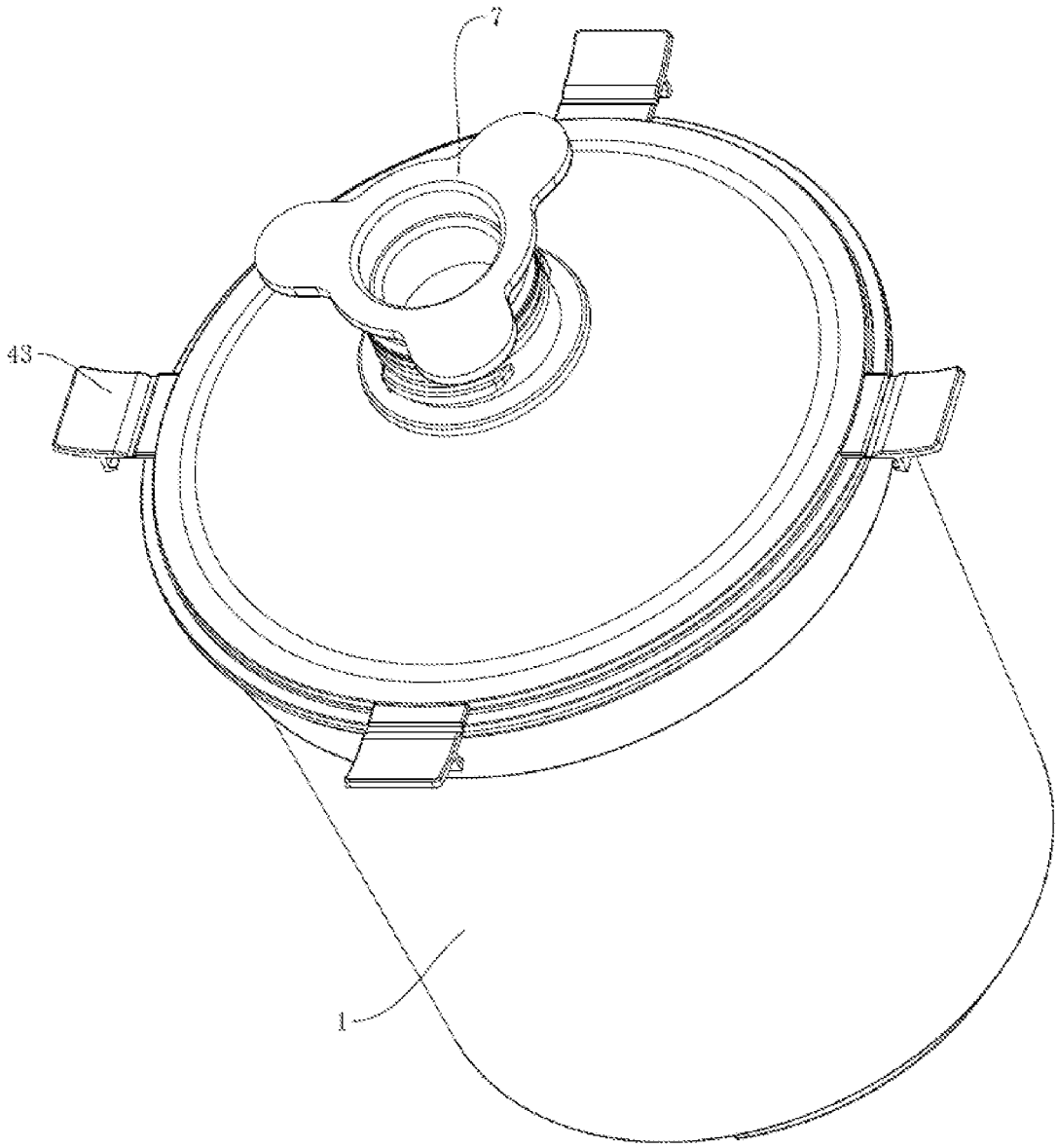
FIG. 17 is an assembly effect view illustrating a plug of an embodiment of the present disclosure.
Figure 18:
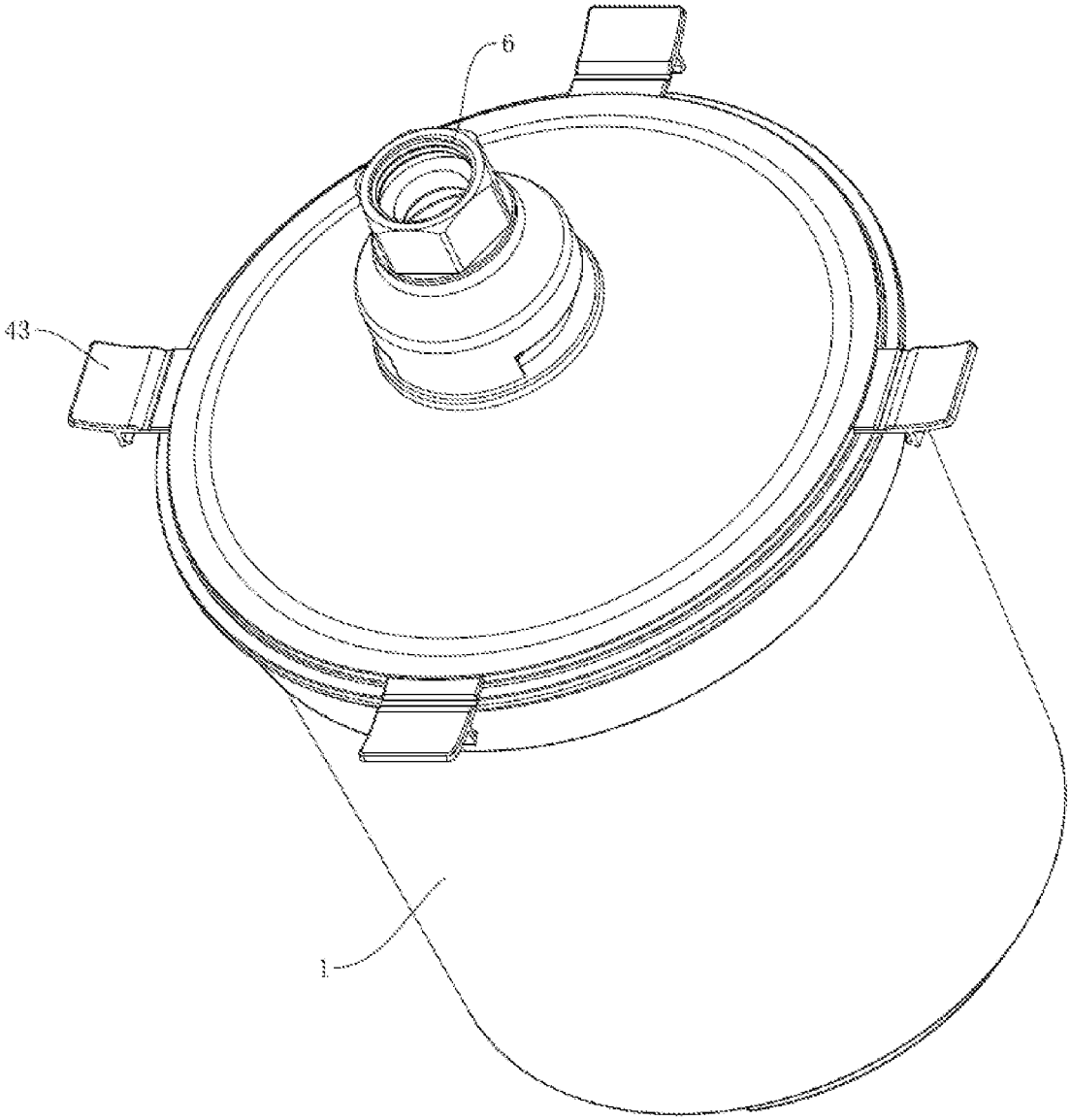
FIG. 18 is an assembly effect view illustrating a connector of an embodiment of the present disclosure.

Accordingly, for the spray pot provided by the present embodiment, whether only the closing valve is adopted or both the closing valve and the one-way ventilation valve are adopted, other structures may be combined with the above embodiments in the event of consistency. For example, the structures of the cover and the body and the connection relationship therebetween may be arranged by reference to the corresponding structures of the above embodiments. In addition, for the spray pot provided by the present embodiment, the detachable first filter mesh may be arranged on the cover, or the plug for sealing the body may be arranged on the cover, or the filter head assembly may be arranged between the cover and the spray gun, or both the first filter mesh and the filter head assembly may be provided, or the like. For example, both the first filter mesh and the filter head assembly are provided in the spray pot as shown in FIG. 16 to FIG. 18. The structures of the cover, the first filter mesh, the plug, the filter head assembly and the like may be arranged by reference to the above embodiments, which are not described herein. One end of the filter head assembly is fixedly connected to the cover through the thread or the clamping buckle or the like, and another end of the filter head assembly is fixedly connected to the spray gun through the second connector.

In the present embodiment, an elastic clamping hook 43 cooperated with an annular clamping groove is arranged on a circumferential side of the cover. Four elastic clamping hook 43 may be provided and distributed on the circumferential side of the cover.

Figure 19:
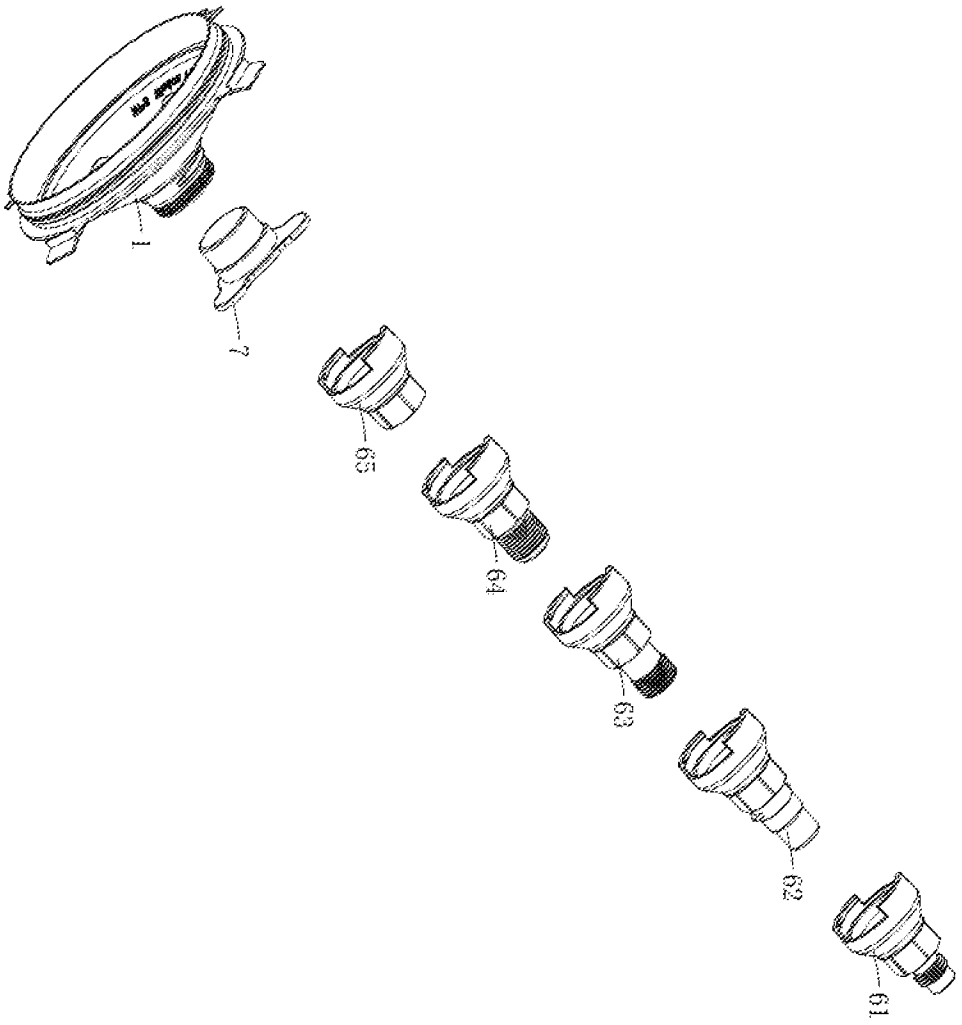
FIG. 19 is a schematic diagram illustrating different connectors, a plug and a cover of an embodiment 4 of the present disclosure.

In the present embodiment, the connector may be adjusted according to the different spray gun. The connector may be connected to an outer wall of the connector in a fastening manner, that is, a thread is arranged on the cover, and an inner wall groove is arranged on the connector. As shown in FIG. 19, the cover 1 may be cooperated with different kinds of first connectors 6. FIG. 19 shows six kinds of the first connectors, which are a first connector-1 61, a first connector-2 62, a first connector-3 63, a first connector-4 64, a first connector-5 65, and a plug 7 respectively.

In the present embodiment, an annular lug stripe is arranged protruding from the bottom of the body. In the case that a small amount of the paint flows out of the ventilation hole 21, the annular lug stripe may prevent the paint from flowing outwards.

A paint spraying system is further provided by the present embodiment, configured to spray paint. The spray painting system may include the spray gun and the spray pot provided by the present embodiment and the above embodiments. The spray gun is communicated with the cover and configured to spray the paint. For the paint spraying system using the above spray pot, the inner liner can be disassembled quickly during the paint spraying operation, so that the body can be reused without cleaning and the efficiency of the paint spraying is improved.

Liquid (such as paint) can flow out of the spray pot of the present disclosure at a constant speed. The liquid can substantially completely flow out of the spray pot with fewer residues and the inner liner is not deformed. The above contents are only preferred embodiments of the present disclosure. Those ordinary skilled in the art can change the specific embodiments and an application scope based on concepts of the present disclosure. The contents of the description should not be understood as limits to the present disclosure.

Industrial Applicability

The detachable inner liner is arranged in the body of the spray pot of the present disclosure, the closing member is arranged at the bottom of the inner liner, and the clamping portions for fixing the closing member are arranged at the bottom of the body, so that the body achieve the purposes of reusability and no cleaning, thereby increasing the working efficiency.

What is claimed is:

1. A spray pot, comprising:

a body;

a detachable inner liner arranged in the body;

a ventilation hole arranged on the inner liner;

a closing member fixed on an outside of the inner liner, configured to close the ventilation hole, and allow fluid to be injected into the inner liner in condition that the closing member closes the ventilation hole, and allow the fluid to flow out of the inner liner from an opening of the body in condition that the closing member is opened;

clamping portions arranged on the body and configured to fix the inner liner and the closing member to the body; and a cover arranged at the opening of the body and tightly fitted with the body and the inner liner.

2. The spray pot according to claim 1, wherein the ventilation hole is located on a bottom of the inner liner, the closing member comprises a one-way ventilation valve, the one-way ventilation valve is configured to allow external air to flow into the inner liner when an air pressure in the inner liner is lower than an external air pressure.

3. The spray pot according to claim 1, wherein a plurality of flanges are arranged on a circumferential side of the closing member; a through-hole is provided in the body; a plurality of notches for allowing the plurality of flanges to pass through are provided at the circumferential side of the through-hole of the body; and bottom walls of the body between adjacent notches form the clamping portions.

4. The spray pot according to claim 3, wherein the closing member is bonded to the inner liner by hot-pressing or ultrasonic waves.

5. The spray pot according to claim 1, wherein the cover is provided with a detachable first filter mesh; and the cover is provided with a lug boss for mounting the first filter mesh and a clamping buckle for fixing the first filter mesh.

6. The spray pot according to claim 1, wherein an annular clamping groove is provided along a circumference of an upper portion of the body; and an elastic clamping hook matched with the annular clamping groove is arranged on the circumferential side of the cover.

7. The spray pot according to claim 1, wherein the cover is provided with a first connector for connecting with the spray gun or a plug for sealing the body.

8. The spray pot according to claim 1, wherein a filter head assembly is arranged between the cover and the spray gun; a first end of the filter head assembly is fixedly connected with the cover by threads; and a second end of the filter head assembly is fixedly connected with the spray gun by a second connector.

9. The spray pot according to claim 8, wherein the filter head assembly comprises a first cover body connected with the cover and a second cover body connected with the second connector; and a detachable second filter mesh is arranged between the first cover body and the second cover body.

10. The spray pot according to claim 1, wherein the one-way ventilation valve comprises a valve body; the bottom of the inner liner is provided with a hole, and the valve body is configured to close the hole to prevent the fluid in the inner liner from flowing out.

11. The spray pot according to claim 1, wherein the one-way ventilation valve comprises an upper cover, a lower cover and a gasket; and a surface of the upper cover in contact with the gasket is provided with ridges.

12. The spray pot according to claim 11, wherein the gasket is a silicone gasket.

13. The spray pot according to claim 11, wherein the one-way ventilation valve further comprises a spring arranged between the upper cover and the gasket.

14. The spray pot according to claim 1, wherein the closing member is a closing valve.

15. The spray pot according to claim 14, wherein the closing valve is a rubber plug or a plastic plug.

16. The spray pot according to claim 1, wherein an annular lug stripe is arranged protruding from a bottom of the body.

* * * * *